US007124618B1

(12) United States Patent
Ghiran et al.

(10) Patent No.: US 7,124,618 B1
(45) Date of Patent: Oct. 24, 2006

(54) CLAMP ASSEMBLY FOR HYDROFORMING DIE

(75) Inventors: Mike M. Ghiran, Lake Orion, MI (US); Sanjay M. Shah, Troy, MI (US); David R. Jensen, Swartz Creek, MI (US); Terry A. Kent, East China, MI (US); Paul D. Larsen, Fenton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/369,248

(22) Filed: Mar. 7, 2006

(51) Int. Cl.
*B21D 26/02* (2006.01)
*B21D 9/15* (2006.01)

(52) U.S. Cl. ..... 72/451; 72/57; 72/60; 72/63; 29/421.1; 100/272

(58) Field of Classification Search ..... 72/54, 72/56, 57, 58, 60, 63, 450, 451; 29/421.1; 100/272, 271
See application file for complete search history.

(56) References Cited

U.S. PATENT DOCUMENTS 2,780,117 A * 2/1957 Bauer et al. ..... 72/451
3,205,551 A * 9/1965 Welter et al. ..... 72/451
4,302,961 A * 12/1981 Leinhaas ..... 72/451
5,046,241 A * 9/1991 Ricard ..... 72/451
5,396,786 A * 3/1995 Bartholomew et al. ..... 72/57
5,415,021 A * 5/1995 Folmer ..... 72/58
5,592,876 A * 1/1997 Son ..... 72/451
5,600,995 A * 2/1997 Sherman ..... 72/451
6,006,567 A * 12/1999 Brown et al. ..... 72/58
6,675,621 B1 * 1/2004 Kleber ..... 72/60

* cited by examiner

*Primary Examiner*—David Jones
(74) *Attorney, Agent, or Firm*—Laura C. Hargitt

(57) ABSTRACT

A clamp assembly for a hydroforming die includes a stationary lower bed to support a lower die half of the hydroforming die, a stationary upper bed spaced above the lower bed, at least one guide post extending between the lower bed and the upper bed, a movable slide disposed between the upper bed and the lower bed and movable along the at least one guide post to support an upper die half of the hydroforming die, a lifting cylinder operatively connected to the movable slide to move the movable slide and upper die half toward and away relative to the lower die half, at least one link mechanism connected to the upper bed and the movable slide to equalize a force on the hydroforming die, and at least one linkage cylinder operatively connected to the at least one link mechanism to activate the at least one link mechanism to prevent the movable slide and upper die half from moving away from the lower die half to keep the hydroforming die closed during a hydroforming process.

20 Claims, 13 Drawing Sheets

FIG 13
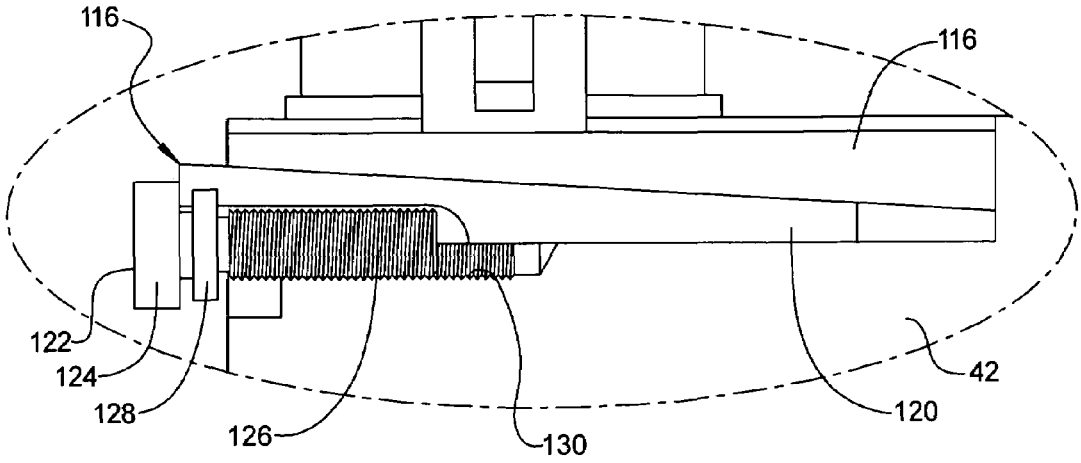
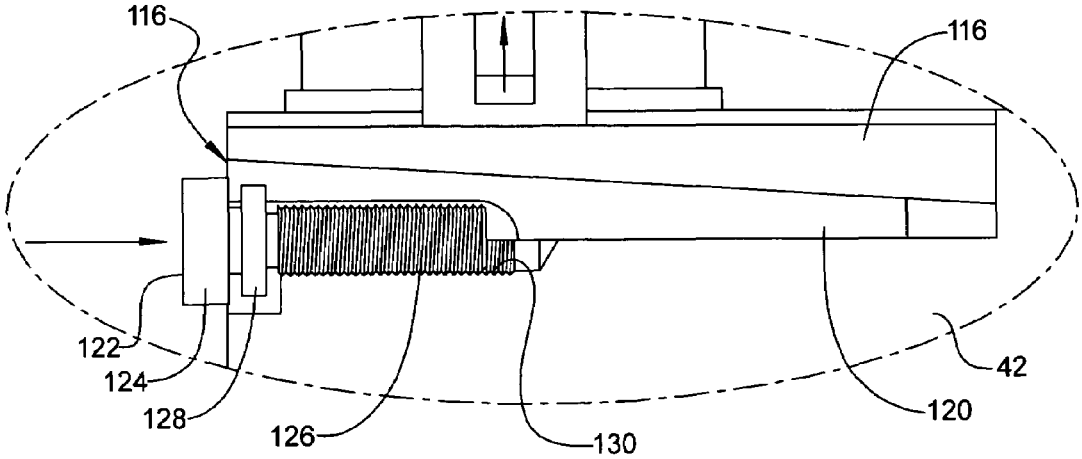
FIG 14

CLAMP ASSEMBLY FOR HYDROFORMING DIE

TECHNICAL FIELD

The present invention relates generally to hydroforming and, more specifically, to a clamp assembly for a hydroforming die.

BACKGROUND OF THE INVENTION

It is known to form a cross-sectional profile of a tubular member by a hydroforming process in which a fluid filled tubular member is placed within a cavity of a die and then the die is closed so that the tubular member is pinched within the die. Fluid pressure is then increased inside the tubular member to expand the tubular member outwardly against the cavity of the die to provide a tubular member having a die formed cross-sectional profile.

During hydroforming of the tubular member, conventional hydraulic presses are used. These presses are large, expensive tools used in the hydroforming process mainly as clamping fixtures to keep a die closed against the hydroform fluid pressure. Conventional hydraulic presses require tremendous energy to keep the die halves of the die closed during the hydroforming process.

To use hydroforming to produce tubular frame rails has created a situation where even the largest hydraulic presses are not able to generate sufficient force to simultaneously hydroform both cavities in a dual cavity die. The force from the highly pressurized forming fluid works directly against the force applied by the press to keep the die closed. The difficultly in keeping the die closed is so great, that some dual cavity dies cannot hydroform both tubular members or parts simultaneously. The effect of pressurizing a single cavity in a dual cavity die not only adds tremendous stress from the off-center part, but it also doubles the part forming time.

As a result, it is desirable to provide a clamp assembly to keep a die set closed during the hydroforming process. It is also desirable to provide a clamp assembly for hydroforming that eliminates the need of larger hydraulic cylinder systems to keep a die set closed during the hydroforming process. It is further desirable to provide a clamp assembly that is less expensive than a hydraulic cylinder to keep a die set closed during the hydroforming process. Therefore, there is a need in the art to provide a new clamp assembly for a hydroforming die that meets at least one of these desires.

SUMMARY OF THE INVENTION

Accordingly, the present invention is a clamp assembly for a hydroforming die including a stationary lower bed to support a lower die half of the hydroforming die, a stationary upper bed spaced above the lower bed, and at least one guide post extending between the lower bed and the upper bed. The clamp assembly also includes a movable slide disposed between the upper bed and the lower bed and movable along the at least one guide post to support an upper die half of the hydroforming die and a lifting cylinder operatively connected to the movable slide to move the movable slide and upper die half toward and away relative to the lower die half. The clamp assembly further includes at least one link mechanism connected to the upper bed and the movable slide to equalize a force on the hydroforming die and at least one linkage cylinder operatively connected to the at least one link mechanism to activate the at least one link mechanism to prevent the movable slide and upper die half from moving away from the lower die half to keep the hydroforming die closed during a hydroforming process.

One advantage of the present invention is that a clamp assembly is provided for a hydroforming die that has the ability to withstand extremely high forces. Another advantage of the present invention is that the clamp assembly incorporates a mechanical link mechanism instead of even larger hydraulic cylinder systems to keep a die set closed during hydroforming. Yet another advantage of the present invention is that the clamp assembly reduces initial capital expenses, allowing less expensive hydraulic systems to be used during hydroforming. Still another advantage of the present invention is that the clamp assembly has lower operating costs due to smaller hydraulic cylinders that cost less to run and less to maintain. A further advantage of the present invention is that the clamp assembly allows faster lower pressure part filling time because the part gets flooded quickly using a weight of a slide and an upper die half to push forming fluid into the part during hydroforming. Yet a further advantage of the present invention is that the clamp assembly provides superior part quality because the hydroforming die remains closed during the hydroforming process. Still a further advantage of the present invention is that the clamp assembly provides faster cycle times because there is less cycle time per part because of faster fill time and more efficient clamping. Another advantage of the present invention is that the clamp assembly provides shorter cycle time on large dual cavity dies since both cavities could be formed at once. Yet another advantage of the present invention is that the clamp assembly has lower energy usage and each corner could have its own tonnage setting.

Other features and advantages of the present invention will be readily appreciated, as the same becomes better understood, after reading the subsequent description taken in conjunction with the accompanying drawings.

BRIEF DESCRIPTION OF THE DRAWINGS

FIG. 13 is a fragmentary elevational view of a portion of the clamp assembly of FIGS. 1 and 2.

FIG. 14 is a view similar to FIG. 13 illustrating an adjustment of the portion of the clamp assembly.

DESCRIPTION OF THE PREFERRED EMBODIMENT

Figure 1:
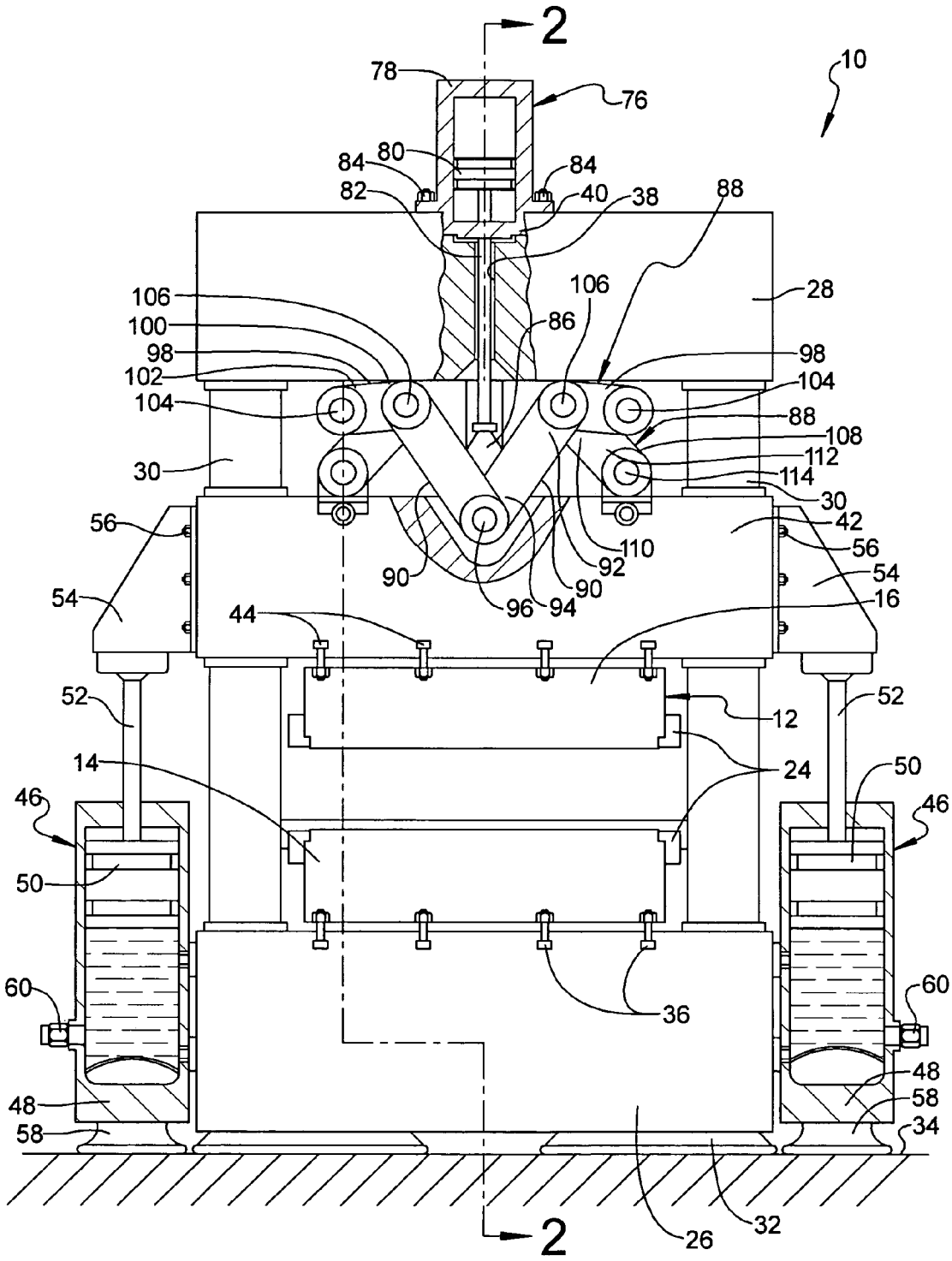
FIG. 1 is a fragmentary elevational view of a clamp assembly, according to the present invention, illustrated in operational relationship with a hydroforming die.
Figure 2:
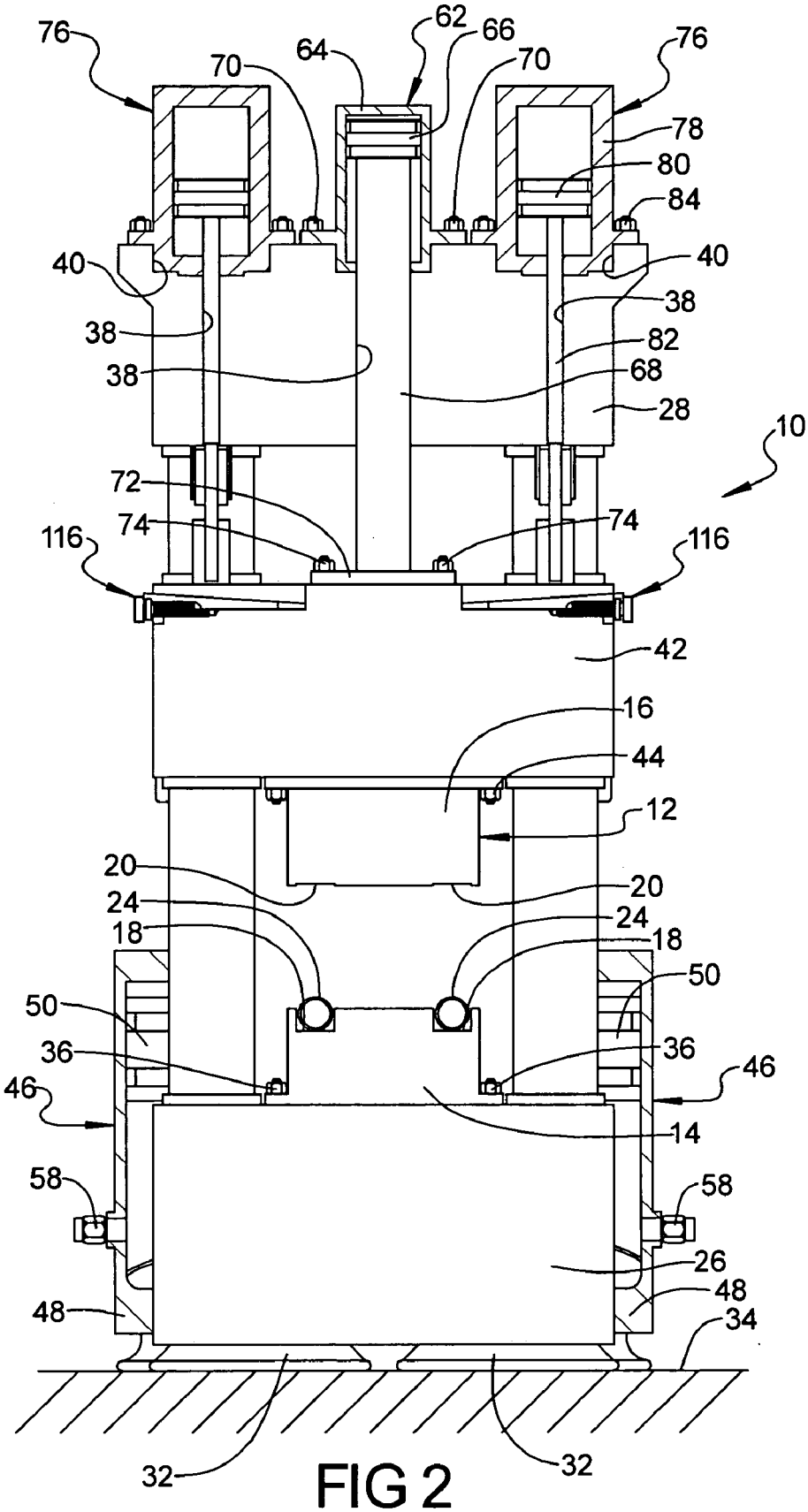
FIG. 2 is a sectional view taken along line 2—2 of FIG. 1.

Referring to the drawings and in particular FIGS. 1 and 2, one embodiment of a clamp assembly 10, according to the present invention, is generally shown for a hydroforming die, generally indicated at 12. The hydroforming die 12 is a die set comprised of a lower die half 14 and an upper die half 16. The lower die half 14 includes at least one, preferably a plurality of tubular forming cavity portions 18. Likewise, the upper die half 16 includes at least one, preferably a plurality of tubular forming cavity portions 20. In the embodiment illustrated, the hydroforming die 12 has a pair of tubular forming cavity portions 18 and 20. It should be appreciated that a combined cross-sectional circumferential measure of the tubular forming cavity portions 18 and 20 total up to generally equal to or slightly greater than the cross-sectional circumferential measure of a tubular member 24.

The clamp assembly 10 also includes a lower bed 26, an upper bed or crown 28 spaced vertically from the lower bed 26, and a plurality of guide posts or slides 30 extending between the lower bed 26 and upper crown 28. The lower bed 26 is generally rectangular in shape. The lower bed 26 includes at least one, preferably a plurality of pads 32 to support the lower bed 26 upon a support surface 34. The lower bed 26 is stationary and supports the lower die half 14. It should be appreciated that the lower die half 14 is connected to the lower bed 26 by a suitable mechanism such as fasteners 36.

The upper bed 28 is supported above the lower bed 26 by the guide posts 30. The upper bed 28 is generally rectangular in shape. The upper bed 28 has at least one, preferably a plurality of passages 38 extending therethrough for a function to be described. The upper bed 28 has a recess 40 extending therein associated with each of the passages 38. It should be appreciated that the upper bed 28 is stationary.

The guide posts 30 extend vertically between the lower bed 26 and the upper bed 28. The guide posts 30 are generally cylindrical in shape and have a generally circular cross-sectional shape. The guide posts 30 are four (4) in number and one guide post 30 is located near each corner of the lower bed 26 and upper bed 28. It should be appreciated that the guide posts 30 separate the lower bed 26 and upper bed 28.

The clamp assembly 10 also includes a movable slide 42 that moves up and down along the guide posts 30. The movable slide 42 is generally rectangular in shape. The movable slide 42 has a plurality of apertures (not shown) extending therethrough through which the guide posts 30 extend. It should be appreciated that the upper die half 16 is connected to the movable slide 42 by a suitable mechanism such as fasteners 44.

The clamp assembly 10 includes at least one, preferably a plurality of part-fill cylinders, generally indicated at 46. In the embodiment illustrated, there are two part-fill cylinders 46. Each part-fill cylinder 46 includes a hollow cylinder member 48, a movable piston member 50 disposed within the cylinder member 48, and a piston rod 52 extending from one end of the piston member 50 and through the cylinder member 48. Each part-fill cylinder 46 also includes a bracket 54 connected to the other end of the piston rod 52 and to the movable slide 42 by a suitable mechanism such as fasteners 56. Each part-fill cylinder 46 further includes a pad 58 on the end of the cylinder member 48 to support the cylinder member 48 upon the support surface 34. Each part-fill cylinder 46 has a port 60 on the cylinder member 48 as a part fill to quickly pre-fill the tubular members 24 in the hydroforming die 12 with low pressure forming fluid. It should be appreciated that the part-fill cylinder 46 allows faster lower pressure part filling time because the tubular members 24 get flooded quickly using the weight of the movable slide 42 and the upper die half 16 to push hydroforming fluid into the tubular members 24 during the hydroforming process.

The clamp assembly 10 also includes at least one lifting cylinder, generally indicated at 62, supported upon the upper bed 28. The lifting cylinder 62 includes a hollow cylinder member 64, a movable piston member 66 disposed within the cylinder member 64, and a piston rod 68 extending from one end of the piston member 66 and through the cylinder member 64. The cylinder member 64 is disposed in a central one of the recesses 40 and is connected to the upper bed 28 by a suitable mechanism such as fasteners 70. The piston rod 68 extends through one of the passages 38 in the upper bed 28. The lifting cylinder 62 also includes a bracket 72 connected to the other end of the piston rod 68 and to the movable slide 42 by a suitable mechanism such as fasteners 74. It should be appreciated that the lifting cylinder 62 moves the movable slide 42 and upper die half 16 toward and away relative to the lower die half 14.

The clamp assembly 10 includes at least one, preferably a plurality of, such as two, linkage cylinders, generally indicated at 76, supported upon the upper bed 28. Each linkage cylinder 76 includes a hollow cylinder member 78, a movable piston member 80 disposed within the cylinder member 78, and a piston rod 82 extending from one end of the piston member 80 and through the cylinder member 78. The cylinder member 78 is disposed in one of the recesses 40 and connected to the upper bed 28 by a suitable mechanism such as fasteners 84. The piston rod 82 extends through one of the passages 38 in the upper bed 28. Each linkage cylinder 76 also includes a connecting bracket 86 connected to the other end of the piston rod 82 and to a link mechanism 88 to be described.

The clamp assembly 10 further includes at least one, preferably a plurality of, such as two, link mechanisms, generally indicated at 88. Each link mechanism 88 includes at least one, preferably a plurality of first linkages 90. The first linkages 90 extend axially between a first end 92 and a second end 94. The second end 94 is connected to the connecting bracket 86 by a suitable mechanism such as a pin 96. Each link mechanism 88 also includes at least one, preferably a plurality of second linkages 98. The second linkages 98 extend axially between a first end 100 and a second end 102. The second end 102 is connected to the upper bed 28 by a suitable mechanism such as a pin 104. The first end 92 of the first linkage 90 is connected to the first end 100 of the second linkage 98 by a suitable mechanism such as a pin 106. Each link mechanism 88 further includes at least one, preferably a plurality of third linkages 108. The third linkages 108 extend axially and have a first end 110 connected to the first end 92 of the first linkage 90 and to the first end 100 of the second linkage 98 by the pin 106. The third linkages 108 also have a second end 112 connected to the movable slide 42 by a suitable mechanism such as a pin 114. It should be appreciated that the linkages 90, 98, 108 rotate about the pins 96, 106, 114. It should also be appreciated that, optionally, to increase shut height to accommodate non-standard hydroforming dies, each link mechanism 88 could be attached to the movable slide 42. It should be appreciated that the linkage cylinders 76 activate the link mechanisms 88 to apply an equalizing force on the movable slide 42 and the upper die half 16 to keep the hydroforming die 12 closed during the hydroforming process.

The clamp assembly 10 may include a tonnage adjustment mechanism, generally indicated at 116, to adjust the tonnage of each of the linkage cylinders 76 and link mechanisms 88. The tonnage adjustment mechanism 116 includes at least one, preferably a plurality of stationary wedges 118 attached to the link mechanisms 88. Each of the stationary wedges 118 is generally triangular in shape and located under a corresponding one of the third linkages 108. The tonnage adjustment mechanism 116 also includes at least one, preferably a plurality of movable wedges 120 disposed adjacent the stationary wedges 118 for cooperating therewith. Each of the movable wedges 120 is generally triangular in shape and located under a corresponding one of the stationary wedges 118. It should be appreciated that the inclined surfaces of the stationary wedges 118 and movable wedges 120 mate with each other.

The tonnage adjustment mechanism 116 further includes at least one, preferably a plurality of fasteners 122 such as screws for cooperating with the movable wedges 120 and the movable slide 42. Each of the fasteners 122 have a head portion 124 extending radially and a threaded shaft portion 126 extending axially from the head portion 124. Each of the fasteners 122 has a flange 128 extending radially and disposed axially between the head portion 124 and the threaded shaft portion 126 to engage the movable wedge 120. The threaded shaft portion 126 threadably engages a threaded portion 130 on the movable slide 42. It should be appreciated that fine tonnage control can be adjusted at each corner by the tonnage adjustment mechanism 116 or by either vertical or horizontal wedges or screws.

Figure 3:
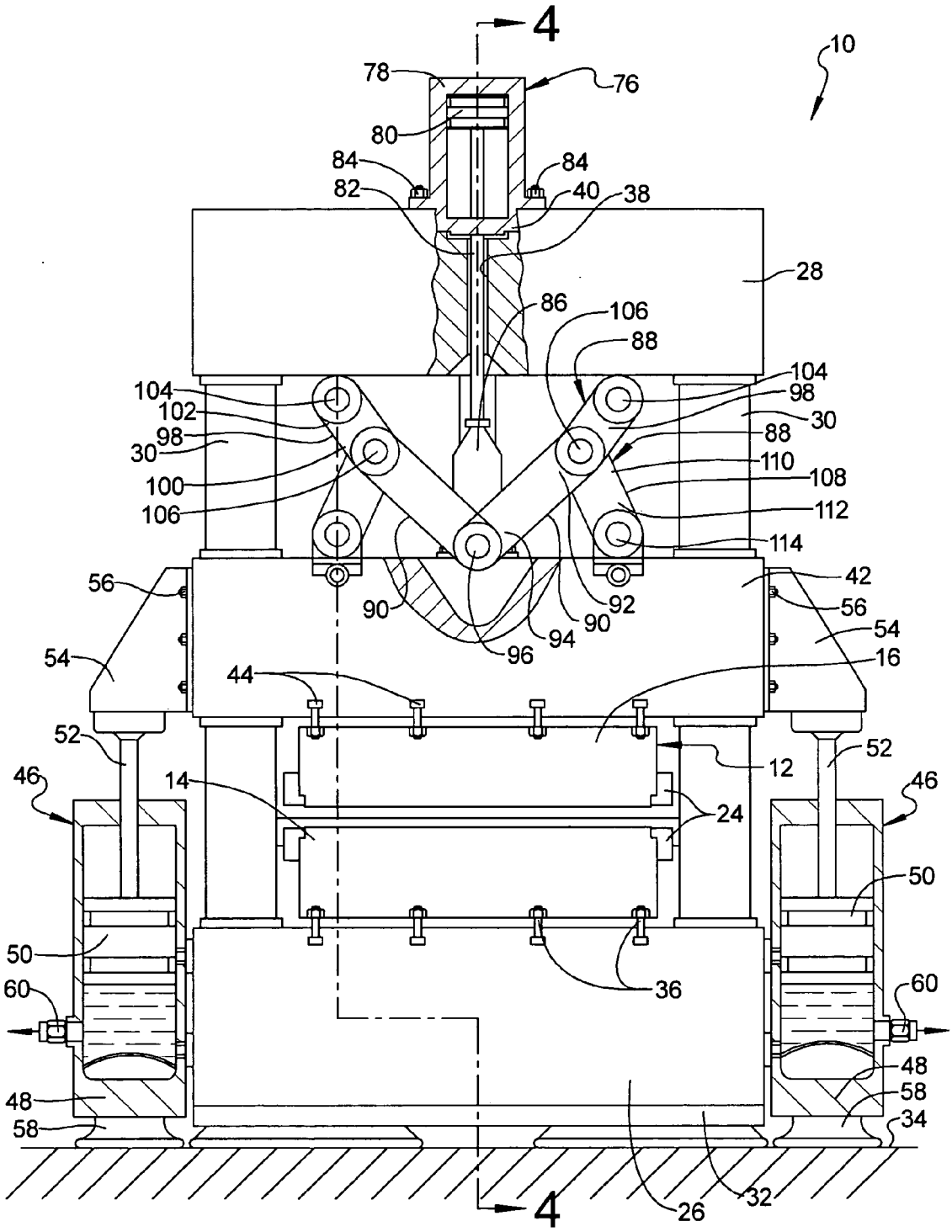
FIG. 3 is a view similar to FIG. 1 illustrating a first step of a hydroforming process.
Figure 4:
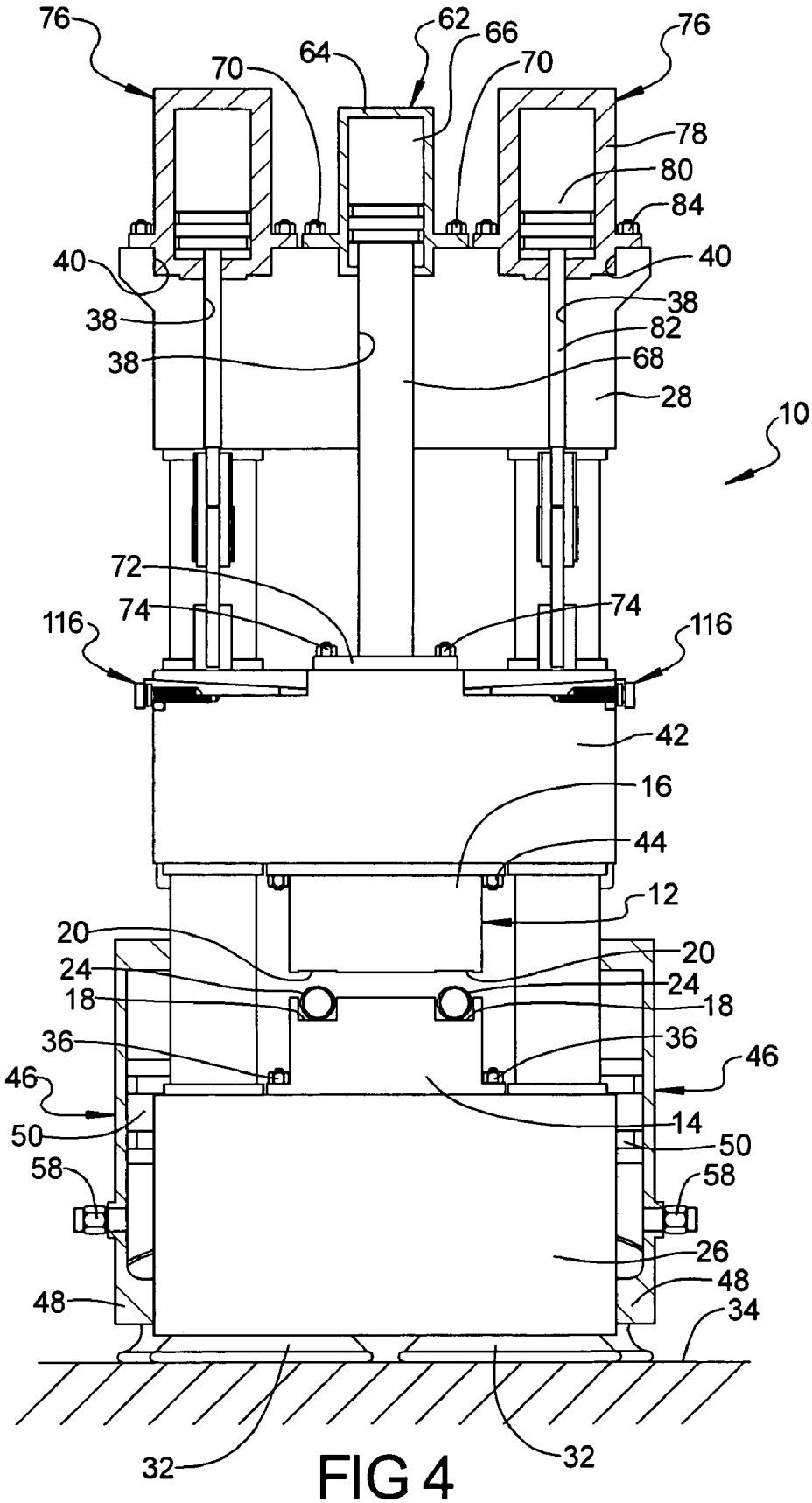
FIG. 4 is a sectional view taken along line 4—4 of FIG. 3.

In operation, a pair of tubular members 24 is disposed between the lower die half 14 and upper die half 16 of the hydroforming die 12. The hydroforming die 12 is used to produce hydroformed parts from the tubular members 24 disposed in each of the cavity portions 18 and 20. As illustrated in FIGS. 1 and 2, the clamp assembly 10 has the movable slide 42 in a raised position. The movable slide 42 begins its downward motion mostly due to the heavy weight of the upper die half 16 and the movable slide 42 as illustrated in FIGS. 3 and 4. As the movable slide 42 is lowered, the bracket 54, piston rod 52, and piston 50 move downward to displace hydroforming fluid (as indicated by the arrows) from the part-fill cylinders 46 through lines (not shown) to the tubular members 24 to pre-fill the tubular members 24 with hydroforming fluid. The downward motion is controlled by the lifting cylinder 62, the link mechanisms 88, and the fluid flow pre-filling the tubular members 24. It should be appreciated that optionally an auxiliary pump (not shown) could be added to provide some or all of the fill and/or hydroform fluid. It should also be appreciated that, as the movable slide 42, nears the bottom of its travel, the final closing force and tonnage is generated by the linkage cylinders 76 and magnified by the mechanical advantage within the link mechanisms 88.

Figure 5:
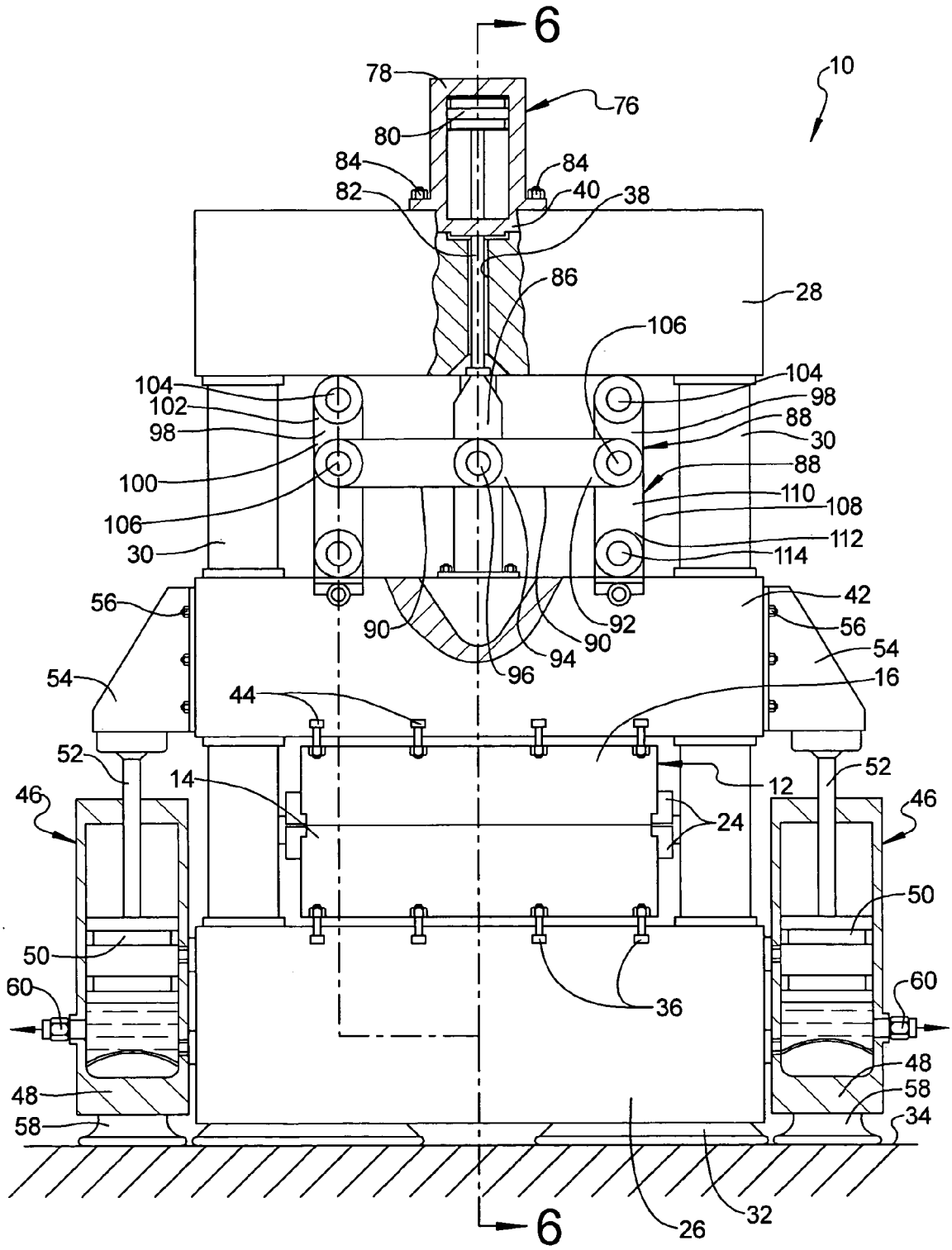
FIG. 5 is a view similar to FIG. 1 illustrating a second step of a hydroforming process.
Figure 6:
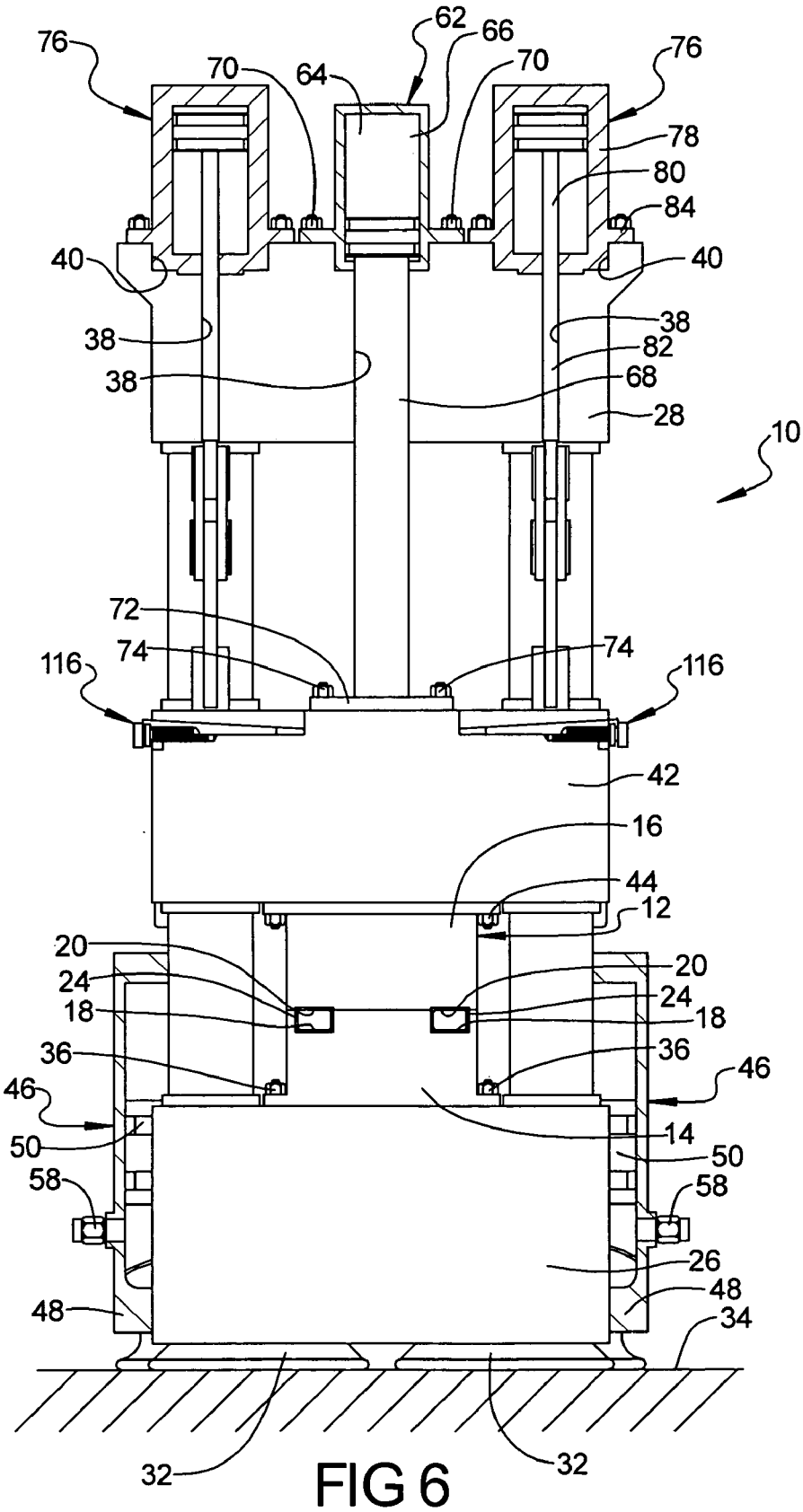
FIG. 6 is a sectional view taken along line 6—6 of FIG. 5.

Referring to FIGS. 5 and 6, once the clamp assembly 10 is closed, the hydroforming process (including final part forming, hole punching, and end trimming) is executed. The hydroforming fluid in the tubular members 26 is pressurized to a forming pressure of approximately 10,000-psi. At this time, the tubular members 26 are formed and take the shape of the cavity portions 18 and 20 by becoming in intimate contact with all surfaces of the cavity portions 18 and 20. The pressure exerted on the upper die half 16 and movable slide 42 is transmitted directly to the first linkages 90 of the link mechanism 88. The position of the first linkages 90 is perpendicular to the second linkages 98, third linkages 108, and connecting bracket 86 and the position of the second linkages 98 is parallel to the third linkages 108. In this position, the linkages 90,98,108 lock straight to form an effective column capable of resisting the upward force generated when the forming fluid becomes highly pressurized to form finished parts inside the die 12. It should be appreciated that the clamp assembly 10 uses the mechanical link mechanisms 88 to achieve a sufficient tonnage to close the die 12 on the unfinished tubular members 24 filled with low pressure forming fluid.

Figure 7:
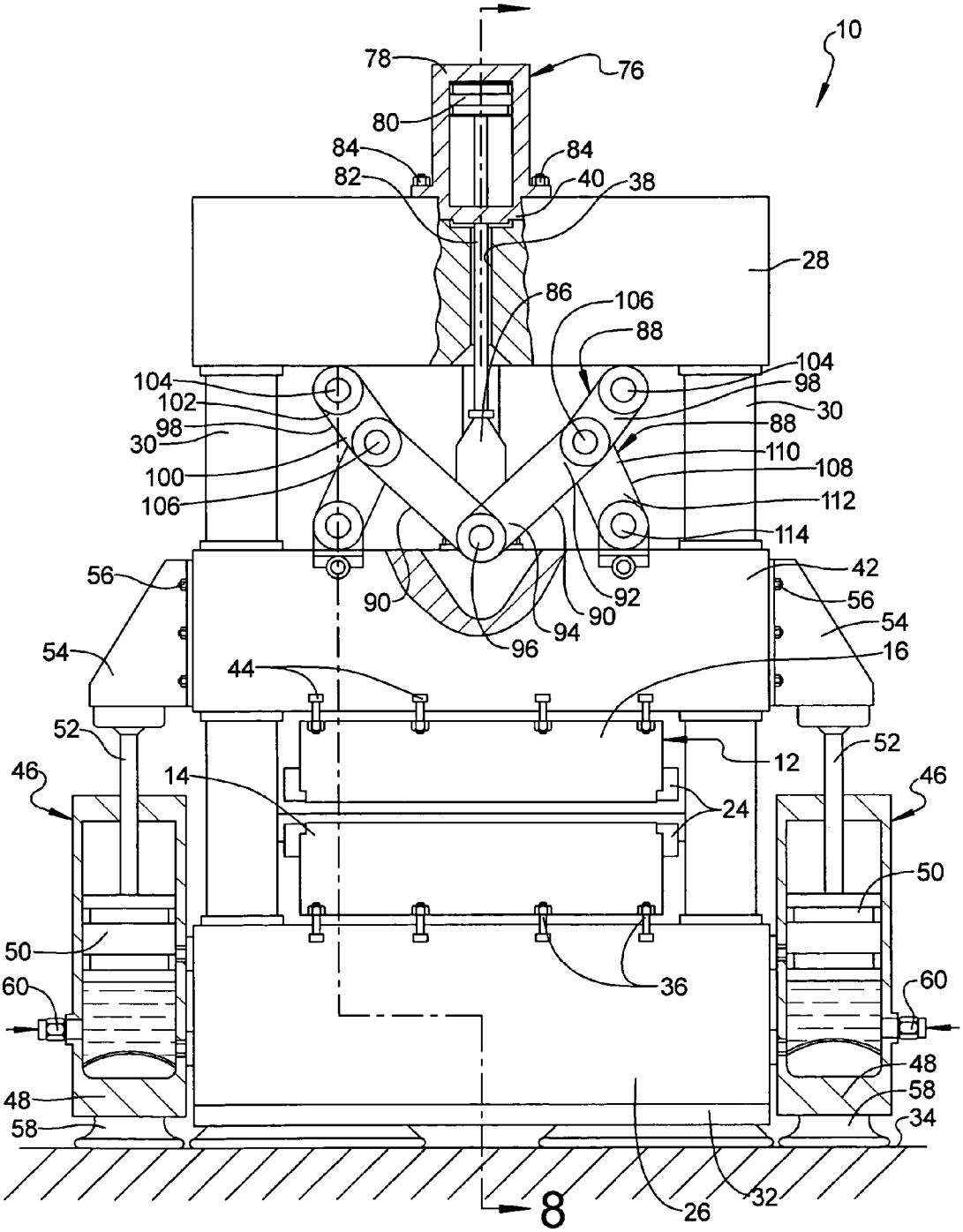
FIG. 7 is a view similar to FIG. 1 illustrating a third step of a hydroforming process.
Figure 8:
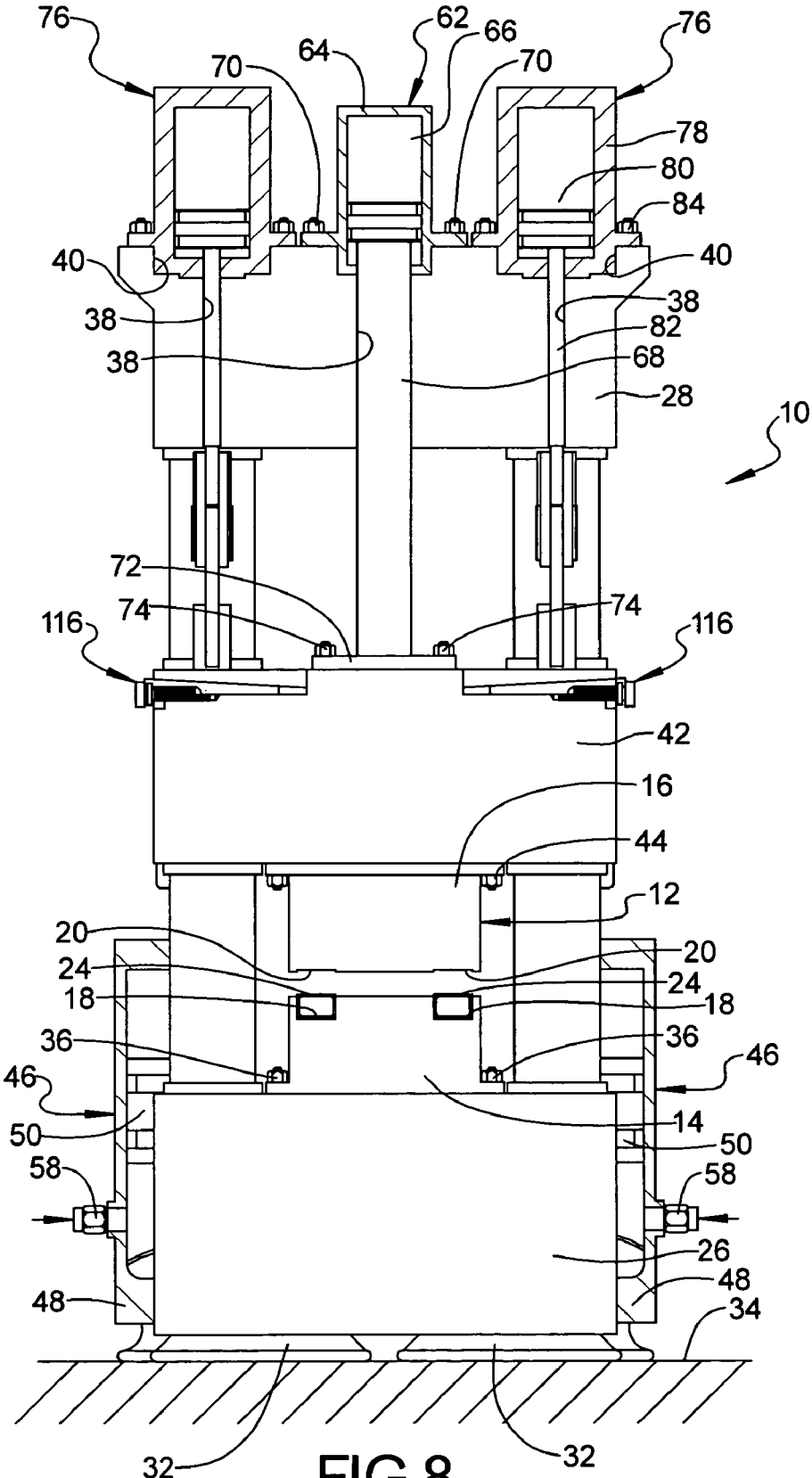
FIG. 8 is a sectional view taken along line 8—8 of FIG. 7.
Figure 9:
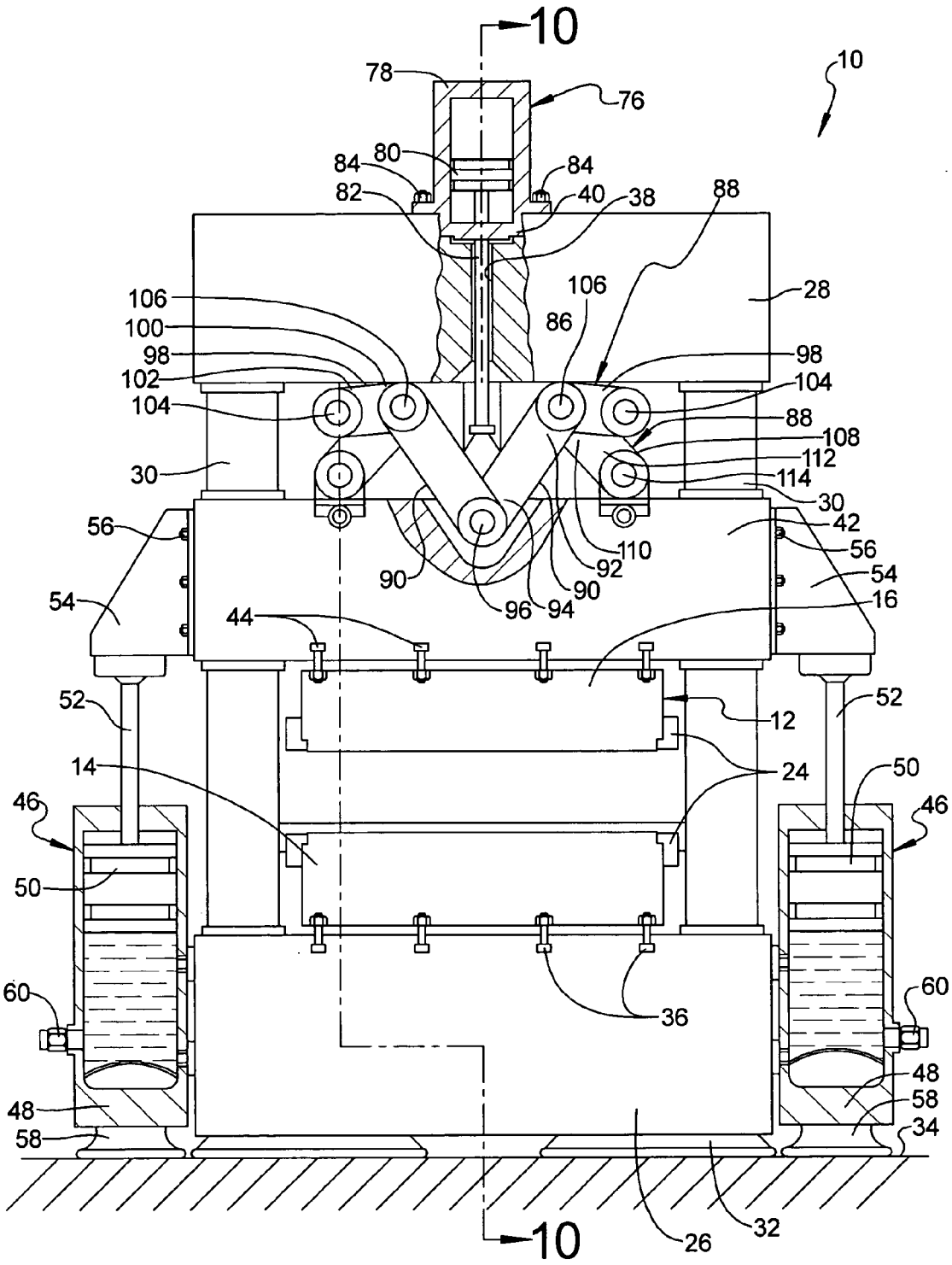
FIG. 9 is a view similar to FIG. 1 illustrating a fourth step of a hydroforming process.
Figure 10:
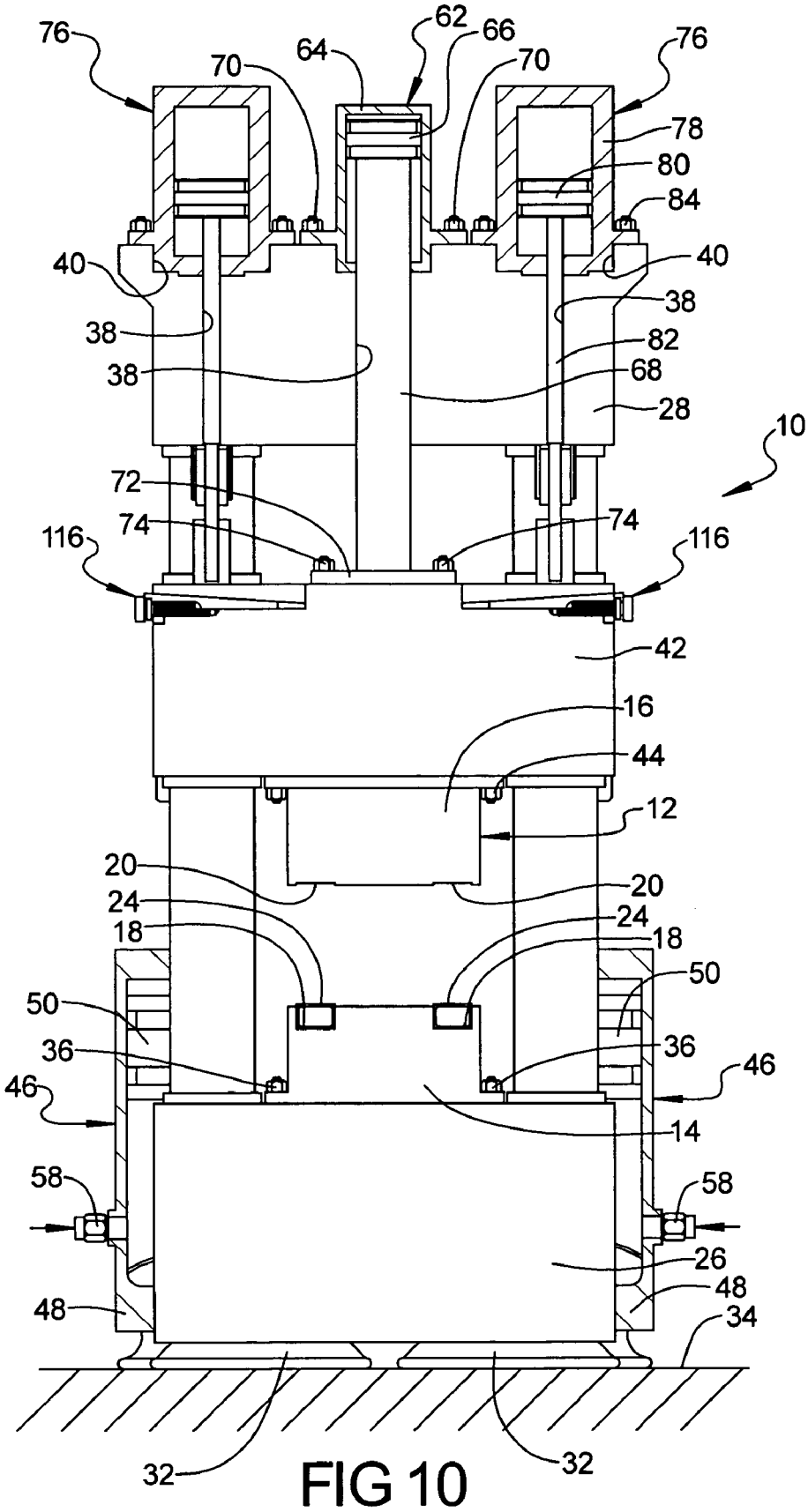
FIG. 10 is a sectional view taken along line 10—10 of FIG. 9.
Figure 11:
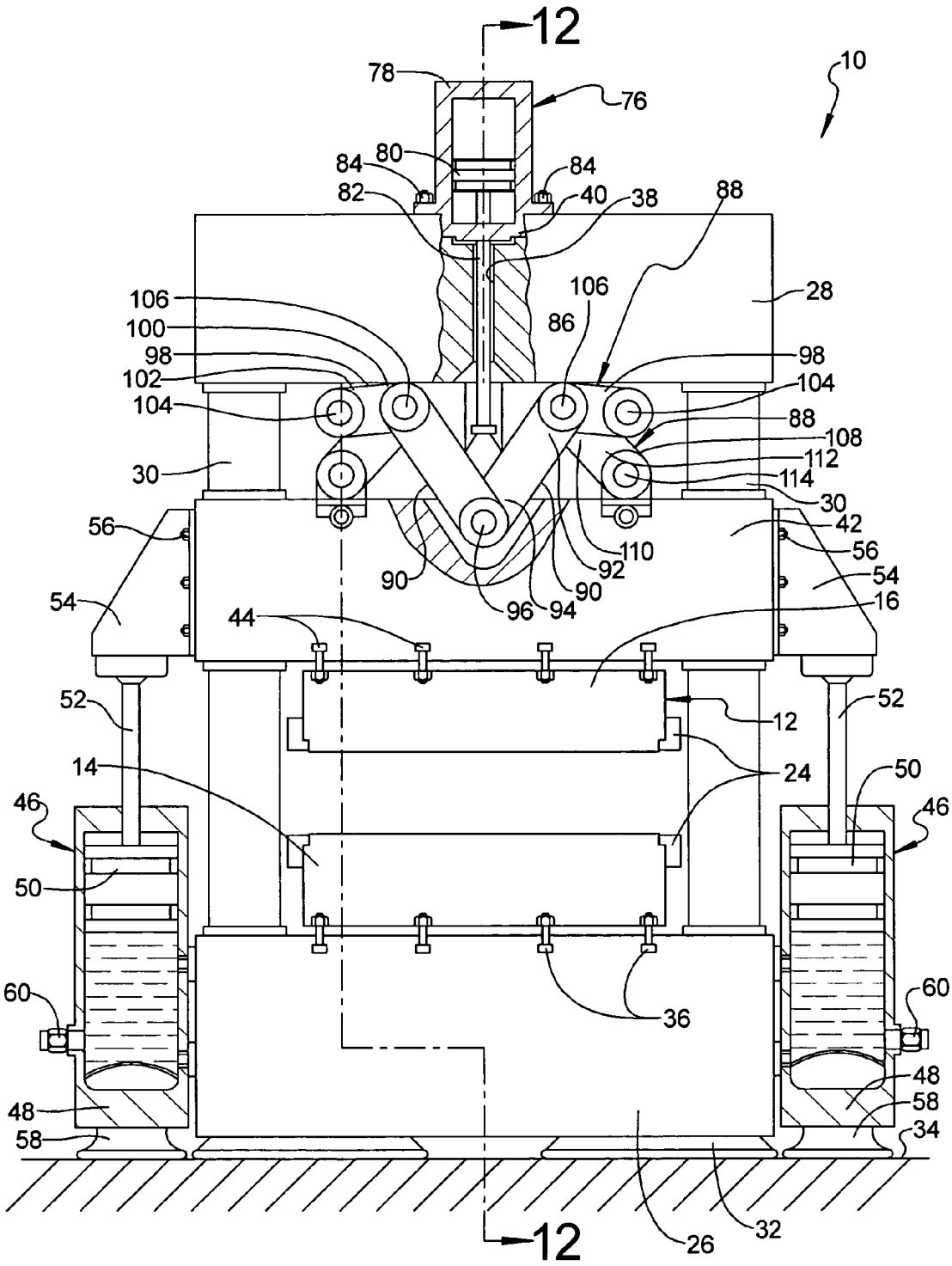
FIG. 11 is a view similar to FIG. 1 illustrating a final step of a hydroforming process.
Figure 12:
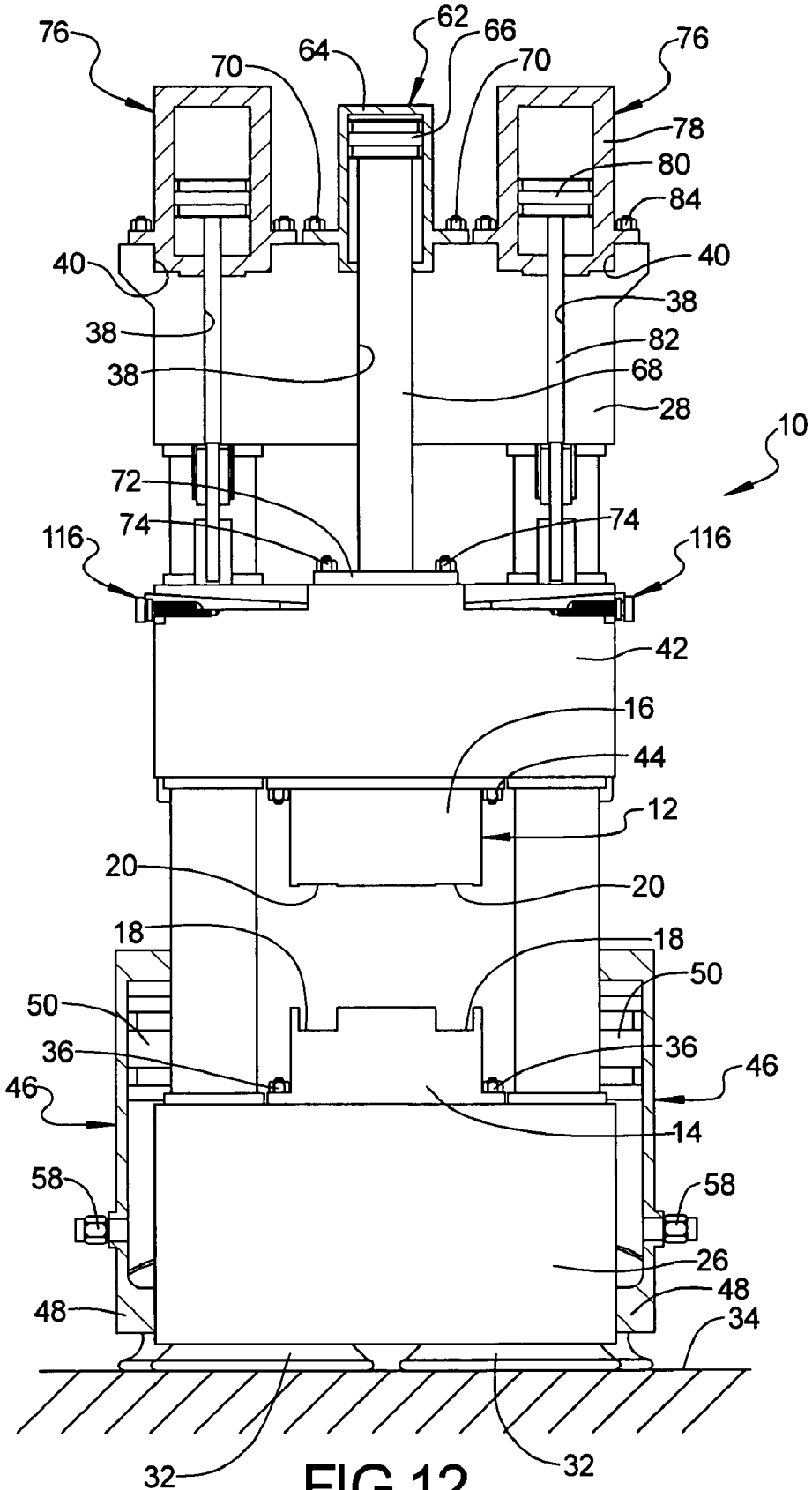
FIG. 12 is a sectional view taken along line 12—12 of FIG. 11.

When the hydroforming process is completed, the linkage cylinders 76 are reversed and the lifting cylinder 62 is simultaneously activated to raise the movable slide 42 as illustrated in FIGS. 7 and 8. When the movable slide 42 is fully raised as illustrated in FIGS. 9 and 10, the finished hydroformed parts are removed as illustrated in FIGS. 11 and 12 and new tubular members 24 are loaded into the hydroforming die 12 for another cycle.

To adjust the tonnage of the clamping assembly 10, the fasteners 122 are turned to move the movable wedges 120 inward or outward relative to the stationary wedges 118. The threaded shaft portion 126 threadably engages the threaded portion 130 on the movable slide 42 to move the movable wedges 120 against the stationary wedges 118. As the movable wedge 120 moves toward the stationary wedge 118 as indicated by the arrow, the inclined surfaces ride against each other and the distance between them increases as indicated by the arrow, thereby increasing the tonnage. As the movable wedge 120 moves away from the stationary wedge 118, the inclined surfaces ride against each other and the distance between them decreases, thereby decreasing the tonnage. It should be appreciated that fine tonnage control can be adjusted at each corner by the tonnage adjustment mechanisms 116.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A clamp assembly for a hydroforming die comprising:

a stationary lower bed to support a lower die half of the hydroforming die;

a stationary upper bed spaced above said lower bed;

at least one guide post extending between said lower bed and said upper bed;

a movable slide disposed between said upper bed and said lower bed and movable along said at least one guide post to support an upper die half of the hydroforming die;

at least one lifting cylinder operatively connected to said movable slide to move said movable slide and the upper die half toward and away relative to the lower die half;

at least one link mechanism connected to said upper bed and said movable slide to equalize a force on the hydroforming die; and at least one linkage cylinder operatively connected to said at least one link mechanism to activate said at least one link mechanism to prevent said movable slide and the upper die half from moving away from the lower die half to keep the hydroforming die closed during a hydroforming process.

2. A clamp assembly as set forth in claim 1 including at least one tonnage adjustment mechanism to adjust a tonnage of said at least one link mechanism.

3. A clamp assembly as set forth in claim 2 wherein said at least one tonnage adjustment mechanism comprises at least one stationary wedge operatively attached to said at least one link mechanism, at least one movable wedge cooperating with said at least one stationary wedge, and a fastener cooperating with said at least one movable wedge and said movable slide.

4. A clamp assembly as set forth in claim 1 wherein said at least one link mechanism comprises a plurality of first linkages having one end connected to said movable slide.

5. A clamp assembly as set forth in claim 4 wherein said at least one link mechanism comprises a plurality of second linkages having one end connected to said first linkages and another end connected to said upper bed.

6. A clamp assembly as set forth in claim 5 wherein said at least one link mechanism comprises a plurality of third linkages having one end connected to said first linkages and said second linkages and another end connected to said movable slide.

7. A clamp assembly as set forth in claim 6 including a plurality of pins to connect said first linkages, said second linkages, and said third linkages together at ends thereof.

8. A clamp assembly as set forth in claim 1 including a bracket interconnecting said at least one lifting cylinder and said at least one link mechanism.

9. A clamp assembly as set forth in claim 1 wherein said at least one linkage cylinder comprises a hollow cylinder member supported by said upper bed, a movable piston member disposed within said cylinder member, and a piston rod extending from one end of said piston member and through said cylinder member and operatively connected to said at least one link mechanism.

10. A clamp assembly as set forth in claim 1 wherein said at least one lifting cylinder comprises a hollow cylinder member supported by said upper bed, a movable piston member disposed within said cylinder member, and a piston rod extending from one end of said piston member and through said cylinder member and operatively connected to said movable slide.

11. A clamp assembly as set forth in claim 1 including at least one part-fill cylinder fluidly connected to the hydroforming die.

12. A clamp assembly as set forth in claim 11 wherein said at least one part-fill cylinder comprises a hollow cylinder member, a movable piston member disposed within said cylinder member, and a piston rod extending from one end of said piston member and through said cylinder member and operatively connected to said movable slide.

13. A clamping and hydroforming assembly comprising:

a lower die half having a plurality of die forming cavities;

an upper die half having a plurality of die forming cavities;

a stationary lower bed to support said lower die half;

a stationary upper bed spaced above said lower bed;

at least one guide post extending between said lower bed and said upper bed;

a movable slide disposed between said upper bed and said lower bed and movable along said at least one guide post to support said upper die half;

at least one lifting cylinder operatively connected to said movable slide to move said movable slide and said upper die half toward and away relative to said lower die half;

at least one link mechanism connected to said upper bed and said movable slide to equalize a force on said upper die half; and at least one linkage cylinder operatively connected to said at least one link mechanism to activate said at least one link mechanism to prevent said movable slide and said upper die half from moving away from said lower die half to keep said upper die half and said lower die half closed during a hydroforming process.

14. A clamping and hydroforming assembly as set forth in claim 13 including at least one tonnage adjustment mechanism to adjust a tonnage of said at least one link mechanism.

15. A clamping and hydroforming assembly as set forth in claim 14 wherein said at least one tonnage adjustment mechanism comprises at least one stationary wedge attached to said at least one link mechanism, at least one movable wedge cooperating with said at least one stationary wedge, and a fastener cooperating with said at least one movable wedge and said movable slide.

16. A clamping and hydroforming assembly as set forth in claim 13 wherein said at least one link mechanism comprises a plurality of first linkages having one end connected to said movable slide.

17. A clamping and hydroforming die assembly as set forth in claim 16 wherein said at least one link mechanism comprises a plurality of second linkages having one end connected to said first linkages and another end connected to said upper bed.

18. A clamping and hydroforming die assembly as set forth in claim 15 wherein said at least one link mechanism comprises a plurality of third linkages having one end connected to said first linkages and said second linkages and another end connected to said movable slide.

19. A clamping and hydroforming die assembly as set forth in claim 18 wherein said at least one link mechanism comprises a plurality of pins to connect said first linkages, said second linkages, and said third linkages together at ends thereof.

20. A clamping and hydroforming assembly comprising:

a lower die half having a plurality of die forming cavities;

an upper die half having a plurality of die forming cavities;

a stationary lower bed to support said lower die half;

a stationary upper bed spaced above said lower bed;

a plurality of guide posts extending between said lower bed and said upper bed;

a movable slide disposed between said upper bed and said lower bed and movable along said guide posts to support said upper die half;

a lifting cylinder operatively connected to said movable slide to move said movable slide and said upper die half toward and away relative to said lower die half;

a plurality of link mechanisms connected to said upper bed and said movable slide to equalize a force on said upper die half; and a plurality of linkage cylinders operatively connected to said link mechanisms to activate said link mechanisms to prevent said movable slide and said upper die half from moving away from said lower die half to keep said upper die half and said lower die half closed during a hydroforming process.

* * * * *